US009134668B2

(12) United States Patent
Ogasawara

(10) Patent No.: US 9,134,668 B2
(45) **Date of Patent: *Sep. 15, 2015**

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Masato Ogasawara, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/468,462

(22) Filed: Aug. 26, 2014

(65) Prior Publication Data

US 2015/0010317 A1 Jan. 8, 2015

Related U.S. Application Data

(63) Continuation of application No. 13/494,130, filed on Jun. 12, 2012, now Pat. No. 8,849,161.

(60) Provisional application No. 61/496,707, filed on Jun. 14, 2011.

(51) Int. Cl.

| | |
|---|---|
| ***G03G 15/01*** | (2006.01) |
| ***G03G 15/20*** | (2006.01) |
| ***G03G 15/00*** | (2006.01) |

(52) U.S. Cl.

CPC ..... *G03G 15/50* (2013.01); *G03G 15/2039* (2013.01); *G03G 15/6585* (2013.01); *G03G 2215/2074* (2013.01)

(58) Field of Classification Search

USPC ..... 399/54, 67, 69, 223, 228

See application file for complete search history.

(56) References Cited

U.S. PATENT DOCUMENTS 5,394,231 A 2/1995 Sudo et al.
7,957,660 B2 * 6/2011 Kaneko et al. ..... 399/67

FOREIGN PATENT DOCUMENTS

JP 10-171198 6/1998

OTHER PUBLICATIONS

U.S. Office Action mailed Oct. 10, 2013 corresponding to U.S. Appl. No. 13/494,130, filed Jun. 12, 2012.

* cited by examiner

*Primary Examiner* — Hoang Ngo
(74) *Attorney, Agent, or Firm* — Amin, Turocy & Watson, LLP

(57) ABSTRACT

According to one embodiment, an image forming apparatus includes an image forming portion configured to selectively form a toner image on an image bearing member using a developing device including a decolorizable toner or a developing device including an undecolorizable toner, a transfer portion configured to transfer the toner image, which is formed on the image bearing member, onto a transfer material, and a fixing portion configured to fix the toner image, which is transferred by the transfer portion, on the transfer material. The undecolorizable toner has at least a fixing temperature range in a range equal to or higher than a fixing temperature lower limit of the decolorizable toner and lower than decoloring temperature of the decolorizable toner.

10 Claims, 5 Drawing Sheets

IMAGE FORMING APPARATUS

CROSS-REFERENCE TO RELATED APPLICATION

This application is a Continuation of application Ser. No. 13/494,130 filed Jun. 12, 2012, which is based upon and claims the benefit of U.S. Provisional Application No. 61/496,707, filed on Jun. 14, 2011; the entire contents of both of which are incorporated herein by reference.

FIELD

Embodiments described herein relate generally to an image forming apparatus and an image forming method.

BACKGROUND

There is a method of forming an image using a decolorizable toner in order to recycle a sheet. The decolorizable toner develops a color during image formation. However, when heat or the like is applied to the decolorizable toner, a color material in the toner loses a color to be decolored. If the decolorizable toner and an undecolorizable toner are combined to form an image, it is possible to erase only an image portion formed with the decolorizable toner without changing an image portion formed with the undecolorizable toner. Therefore, it is expected that an image forming apparatus that uses the undecolorizable toner and the decolorizable toner is applied to a wider variety of uses.

As a full-color image forming apparatus suitable for high-speed printing, a quadruple tandem full-color image forming apparatus is known in which four photoconductive members are arranged and developing devices including undecolorizable yellow (Y), magenta (M), cyan (C), and black (Bk) toners are respectively arranged around the photoconductive members. However, when a decolorizable toner is additionally arranged in such an image forming apparatus, if a photoconductive member exclusive for the decolorizable toner is provided, the apparatus increases in size. The quadruple tandem apparatus forms an image with all of plural toners or one or two or more toners selected out of the toners. In this case, to prevent wear and the like, the photoconductive member for an unselected toner is desirably not driven to rotate. However, if the decolorizable toner is additionally arranged in addition to the undecolorizable toner, there are a mode for forming an image with the undecolorizable toner alone and a mode for forming an image with the decolorizable toner alone. Therefore, a complicated switching structure and a complicated apparatus configuration are necessary to switch such image forming modes.

DETAILED DESCRIPTION

In general, according to one embodiment, an image forming apparatus includes: an image forming portion configured to selectively forma toner image on an image bearing member using a developing device including a decolorizable toner or a developing device including an undecolorizable toner; a transfer portion configured to transfer the toner image, which is formed on the image bearing member, onto a transfer material; and a fixing portion configured to fix the toner image, which is transferred by the transfer portion, on the transfer material, wherein the undecolorizable toner has at least a fixing temperature range between first temperature equal to or higher than a fixing temperature lower limit of the decolorizable toner and second temperature lower than decolorizing temperature of the decolorizable toner.

Embodiments are explained below with reference to the accompanying drawings.

Figure 1:
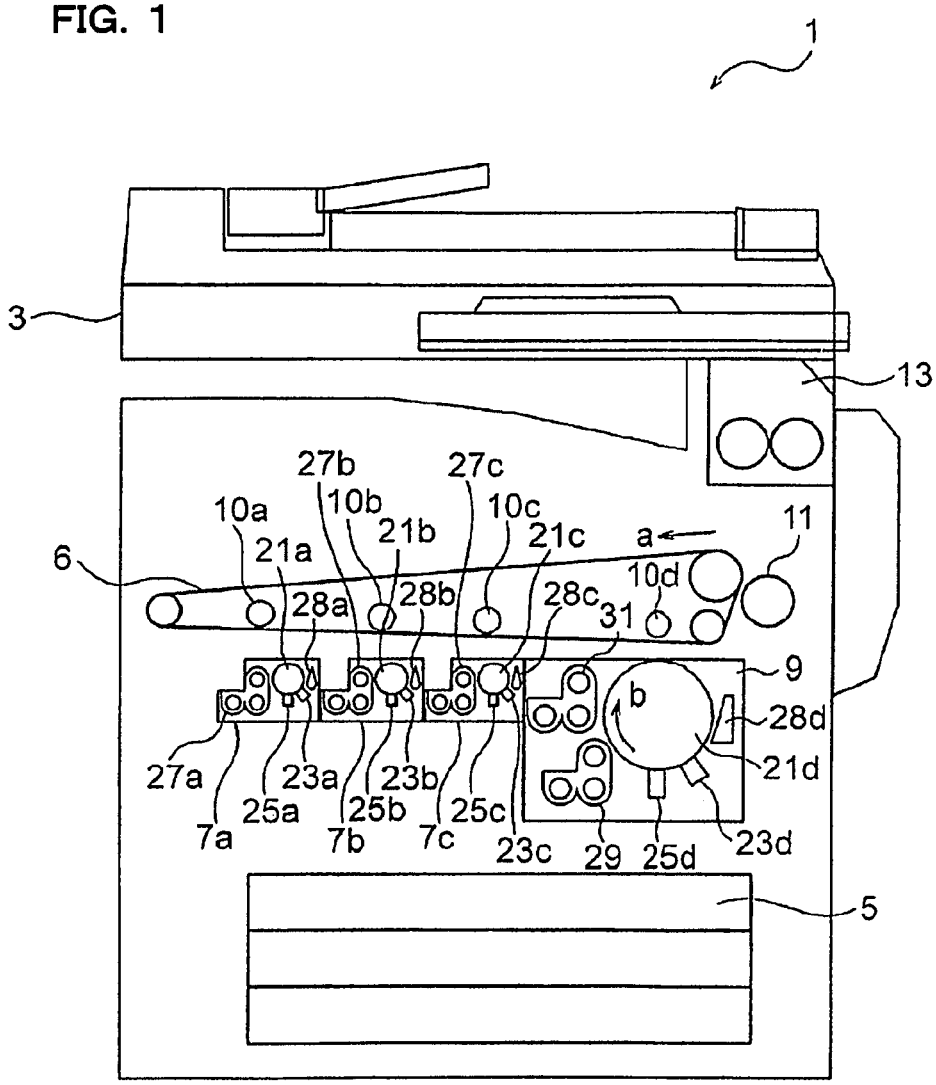
FIG. 1 is a sectional view of an image forming apparatus according to an embodiment.

FIG. 1 is an exemplary schematic configuration diagram of an image forming apparatus according to a first embodiment. An MFP 1 is an image forming apparatus employing a quadruple tandem process. The MFP 1 includes, in an upper part thereof, a scanner 3 that scans an original document. A paper feeding cassette 5 that stores sheets is arranged in a lower part of the MFP 1. The MFP 1 includes, between the scanner 3 and the paper feeding cassette 5, an intermediate transfer belt 6 movable in an arrow "a" direction in the figure and four image forming portions 7*a*, 7*b*, 7*c*, and 9 arranged around the intermediate transfer belt 6. The image forming portions 7*a*, 7*b*, and 7*c* configure a first image forming portion. The image forming portion 9 configures a second image forming portion. The image forming portions 7*a*, 7*b*, and 7*c* respectively form images with an undecolorizable yellow toner (hereinafter sometimes referred to as Y toner), an undecolorizable magenta toner (hereinafter sometimes referred to as M toner), and an undecolorizable cyan toner (hereinafter sometimes referred to as C toner). The image forming portion 9 forms an image with an undecolorizable black toner (hereinafter sometimes referred to as BK toner) or an undecolorizable blue toner (hereinafter sometimes referred to as E toner). Transfer rollers 10*a*, 10*b*, 10*c*, and 10*d* are arranged to be opposed to the image forming portions 7*a*, 7*b*, 7*c*, and 9 across the intermediate transfer belt 6. A secondary transfer roller 11 that transfers toner images, which are formed on the intermediate transfer belt 6 by the image forming portions 7*a*, 7*b*, 7*c*, and 9, onto a sheet fed from the paper feeding cassette 5 is arranged downstream of the image forming portion 9 along a moving direction of the intermediate transfer belt 6. A fixing device 13 for fixing the toner images on the sheet is arranged below the secondary transfer roller 11 along a traveling direction of the sheet fed from the paper feeding cassette 5.

The configurations of the image forming portions 7*a*, 7*b*, and 7*c* are the same except the toners stored therein. Therefore, the configuration of the image forming portion 7*a* is explained as an example of the configurations of the image forming portions 7*a*, 7*b*, and 7*c*.

The image forming portion 7*a* includes a photoconductive drum 21*a*. Around the photoconductive drum 21*a*, a charging device 23*a*, an exposing device 25*a* of an LED type, and a developing device 27*a* are arranged. The charging device 23*a* charges the photoconductive drum 21*a*. The exposing device 25*a* exposes the charged photoconductive drum 21*a* to light according to image information. The developing device 27*a* stores an undecolorizable yellow toner and develops an electrostatic latent image formed by the exposing device 25*a*. Further, the image forming portion 7*a* includes a cleaning device 28*a* that removes a toner remaining on the photoconductive drum 21*a* after the toner image on the photoconductive drum 21*a* is transferred by the transfer roller 10*a*.

Similarly, the image forming portions 7*b* and 7*c* respectively include photoconductive drums 21*b* and 21*c*, charging devices 23*b* and 23*c*, exposing devices 25*b* and 25*c*, developing devices 27*b* and 27*c*, and cleaning devices 28*b* and 28*c*. However, a toner stored in the developing device 27*b* is an undecolorizable magenta toner and a toner stored in the developing device 27*c* is an undecolorizable cyan toner.

The image forming portion 9 includes a photoconductive drum 21*d*. The photoconductive drum 21*d* rotates along an arrow "b" direction in the figure. Around the photoconductive drum 21*d*, a charging device 23*d* and an exposing device 25*d* of the LED type are arranged. The charging device 23*d* charges the photoconductive drum 21*d*. The exposing device 25*d* exposes the charged photoconductive drum 21*d* to light according to image information. Developing devices 29 and 31 are arranged downstream of the exposing device 25*d* along a rotating direction of the photoconductive drum 21*d* to be opposed to the photoconductive drum 21*d*. The developing device 29 stores a decolorizable blue toner and the developing device 31 stores an undecolorizable black toner. The developing devices 29 and 31 are selectively used for the photoconductive drum 21*d*. The developing device 29 or 31 performs development. The image forming portion 9 includes a cleaning device 28*d* that removes a toner on the photoconductive drum 21*d* after a toner image formed by the developing device 29 or 31 is transferred onto the intermediate transfer belt 6 by the transfer roller 10*d*.

The decolorizable blue toner stored in the developing device 29 can cause, for example, a reversible color developing and decoloring action in which, when the temperature of the decolorizable blue toner reaches temperature equal to or higher than specific temperature, the decolorizable blue toner is decolored and, when the temperature drops to temperature equal to or lower than specific recoloring temperature, the decolorizable blue toner develops a color.

A color material in use is not specifically limited as long as the color material is decolored when heated and is recolored when cooled. However, leuco dye is used as a generally well-known color material. A color developing agent, a decolorizable agent, a discoloring temperature adjusting agent, and the like are combined as appropriate to select a color material that is decolored at temperature equal to or higher than certain fixed temperature and recolored at temperature equal to or lower than certain fixed temperature.

Figure 2:
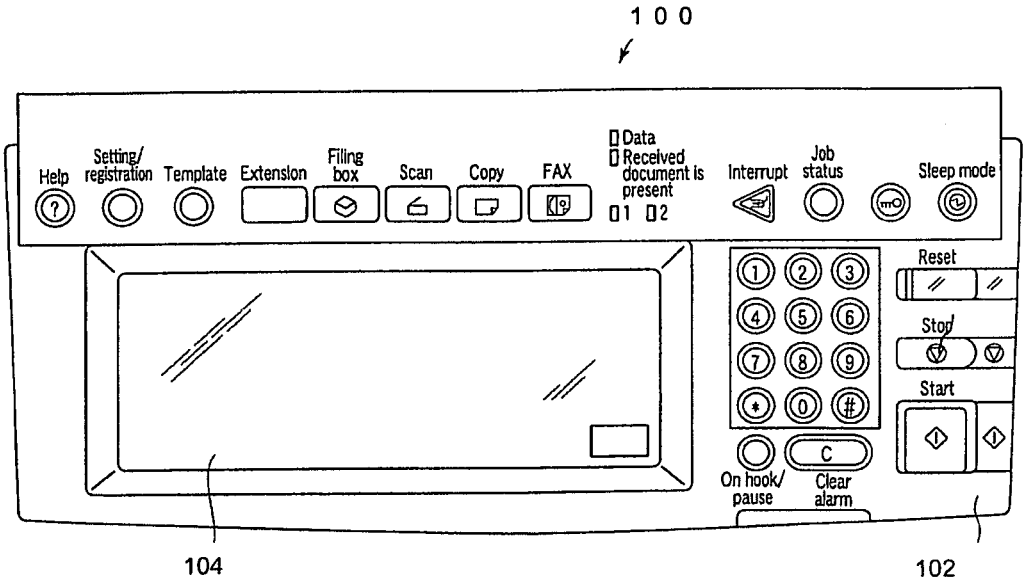
FIG. 2 is an external view of an operation portion of the image forming apparatus.

FIG. 2 is an external view of a control panel 100 functioning as an operation portion included in the MFP 1. The control panel 100 includes various input keys 102 and a liquid crystal panel 104. The input keys 102 include a start key and a ten key.

The MFP 1 can select any one from among (1) a mode for forming an image with only a decolorizable toner (hereinafter referred to as decolorizable toner mode), (2) a mode for combining the decolorizable toner and an undecolorizable toner to form an image (hereinafter referred to as mixed mode), and (3) a mode for forming an image with only the undecolorizable toner including (3-1) an undecolorizable toner single color mode and (3-2) an undecolorizable toner color mode). In the undecolorizable toner color mode, at least two toner is selected from Y toner, M toner, C toner, BK toner for the image forming process and includes undecolorizable toner full color mode.

A user performs switching of these modes by inputting an instruction from the control panel 100.

In the case of the decolorizable toner mode, the developing device 29 is used. In other words, an image by the blue decolorizable toner is formed.

In the case of the mixed mode, an image is formed by one to three image forming portions selected out of the image forming portions 7*a*, 7*b*, and 7*c* and the image forming portion 9 that uses the developing device 29. In other words, the toner(s) of one to three colors selected out of yellow, magenta, and cyan and the blue decolorizable toner are combined to form an image. However, since the temperature of the blue decolorizable toner reaches the decoloring temperature when fixed by the fixing device 13, the blue toner is decolored and is in an invisible state on a sheet.

The decolorizable toner records information concerning image formation such as a date of formation of an image on a sheet and a model number of the image forming apparatus. By recording such information in an invisible form, when the information is necessary later, the sheet is cooled to cause the decolorizable toner to develop a color. The decolorizable toner is desirably recorded at an end or the like of the sheet not to overlap the undecolorizable toner.

If an image is formed with only the undecolorizable toner, an image is formed by one to four image forming portions selected out of the image forming portions 7*a*, 7*b*, and 7*c* and the image forming portion 9 that uses the developing device 31. In other words, an image of a single color selected out of yellow, magenta, cyan, and black or a color image of two to four colors selected out of these colors is formed.

In the case of the decolorizable toner mode and a black toner single color mode among undecolorizable toner single color modes, the image forming portions 7*a* to 7*c* do not operate. In the decolorizable toner mode and the black toner single color mode, the intermediate transfer belt 6 is moved by a not-shown moving mechanism to come into contact with only the photoconductive drum 21*d*. Consequently, the image forming portions 7*a* to 7*c* are not unnecessarily driven to prevent wear of the photoconductive drums 21*a* to 21*c*, the intermediate transfer belt 6, and the like.

As explained above, the image forming portion 9 selectively performs development on the photoconductive drum 21*d* using the decolorizable toner or the black toner. Therefore, the apparatus can be reduced in size compared with a configuration in which a photoconductive drum exclusive for the decolorizable toner is provided. The MFP 1 performs switching for causing only the image forming portion 9 to operate when the decolorizable toner mode or the black toner single color mode is selected and causing the image forming portions 7*a* to 7*c* and the image forming portion 9 to operate when the mixed mode or the undecolorizable toner color mode is selected. Consequently, it is possible to form images corresponding to the various modes.

Figure 3:
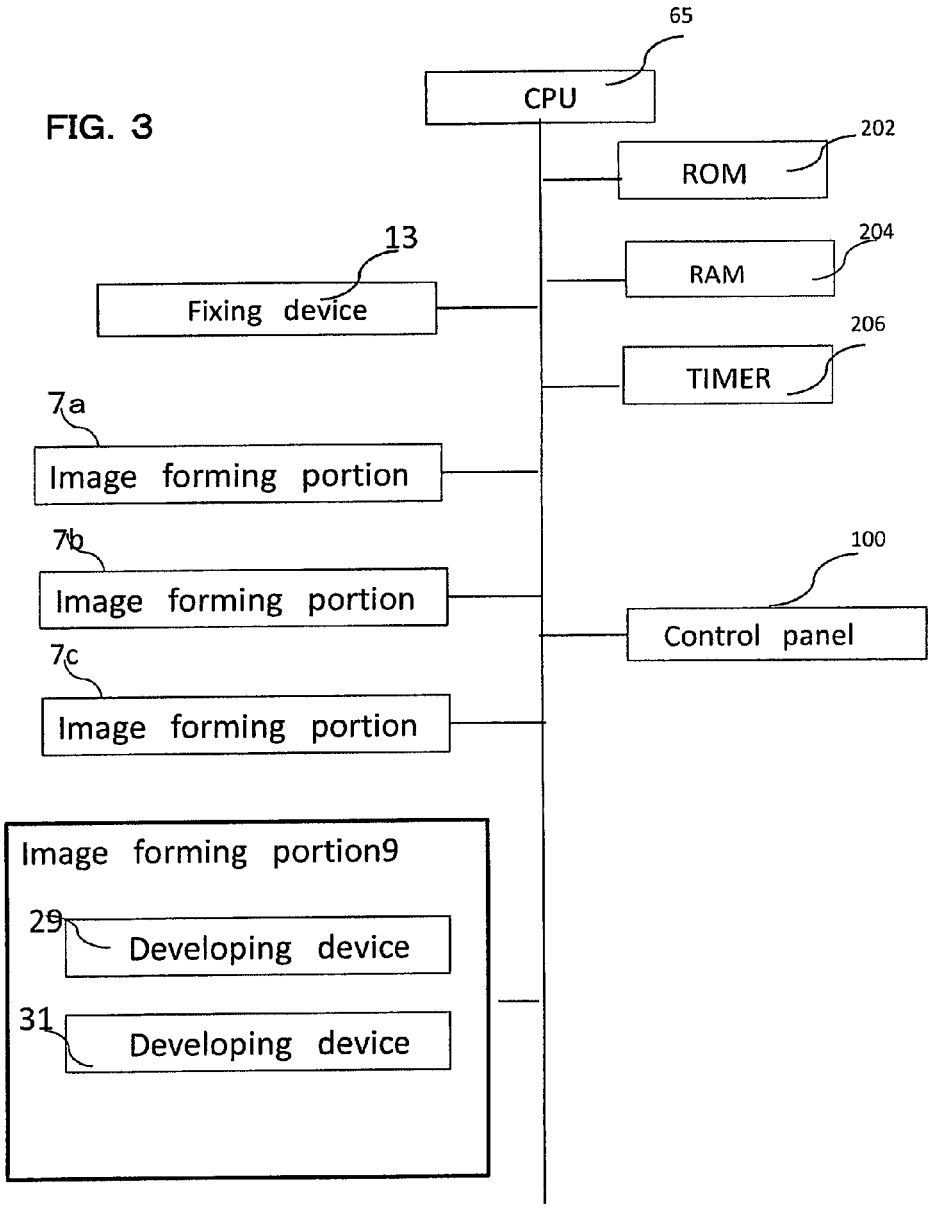
FIG. 3 is a block diagram of the configuration of a control system of the image forming apparatus.

FIG. 3 is a diagram of a main configuration of a control system of the MFP 1 according to this embodiment.

The MFP 1 includes the image forming portions 7*a*, 7*b*, 7*c*, and 9. The MFP 1 further includes a CPU 65 functioning as a control portion, a ROM 202, a RAM 204, and the control panel 100. These portions are connected via a system bus. The CPU 65 selects, according to an image forming mode designated from the control panel 100, an image forming portion, which the CPU 65 should cause to operate, out of the image forming portions 7*a*, 7*b*, 7*c*, and 9 and determines which of the developing device 29 and the developing device 31 in the image forming portion 9 the CPU 65 should cause to operate.

The CPU 65 controls the portions connected via the system bus. The ROM 202 stores various control programs necessary for the MFP 1 to operate. The control programs are executed by the CPU 65. The RAM 204 is a memory that temporarily stores data generated during the execution of the control programs.

The toners in this embodiment are explained.

First, the undecolorizable yellow, magenta, and cyan toners and the black toner in the developing device 31 are explained. Material compositions of the toners are represented by part by weight.

Toner Particle Material Composition

| | |
|---|---|
| Binder resin (polyester resin) | 90 parts by weight |
| Binder resin (crystalline polyester) | 2 parts by weight |
| Coloring agent | 5 parts by weight |
| Wax (propylene wax) | 2 parts by weight |
| Charge control agent (quaternary ammonium salt) | 1 part by weight |

Concerning coloring agents, first yellow G was used as a Y coloring agent, carmine FB was used as an M coloring agent, phthalocyanine blue was used as a C coloring agent, and acetylene black was used as a B coloring agent to obtain toner particle materials of the four colors.

After the toner particle materials of the four colors of yellow, magenta, cyan, and black were mixed using a Henschel mixer, the toner particle materials were melted and kneaded by a twin screw extruder.

After being cooled, an obtained melted and kneaded product was coarsely milled by a hammer mill and then finely milled and classified by a jet mill to obtain toner particles of the four colors having a volume average diameter of 8.0 μm.

0.3 part by weight of silicon dioxide having a primary particle diameter of 12 nm and 0.3 part by weight of titanium dioxide having a primary particle diameter of 20 nm were added to each of the obtained toner particles of the four colors. Further, 0.01 part by weight of zinc stearate serving as metal soap was added to each of the magenta toner particles, the cyan toner particles, and the black toner particles without being added to the yellow toner particles. The toner particles were mixed by the Henschel mixer to respectively manufacture the toners of the four colors.

6 parts by weight of the toners were mixed with 94 parts by weight of silicone coated carrier to respectively manufacture developers of the four colors. The developers were filled in the respective developing devices 27*a*, 27*b*, 27*c*, and 31.

All temperature ranges in which the yellow toner, the cyan toner, the magenta toner, and the black toner can be fixed on a sheet are 90° C. to 120° C.

The decolorizable toner (E) in the developing device 29 is explained.

Manufacturing of Encapsulated Erasable Colored Particulates;

A color material was prepared as follows. 10 parts by weight of CVL (crystal violet lactone) which is a leuco dye as a color developable agent, 10 parts by weight of benzyl 4-hydroxybenzoate as a color developing agent, and 80 parts by weight of 4-benzyloxyphenylethyl laurate as a temperature control agent were mixed, and the resulting mixture was heated and melted. The resulting melted mixture was mixed with an aromatic polyvalent isocyanate prepolymer as a wall film material, and the resulting solution was added dropwise to an aqueous solution of polyvinyl alcohol. Then, a water-soluble aliphatic modified amine was added thereto to effect dispersion, whereby the color material was microencapsulated. This microencapsulated partible is a colored particles A.

When the colored particles A were measured by SALD700 manufactured by Shimadzu Corporation, a volume average particle diameter of the colored particles A was 2 Complete decoloring temperature Th was 107 C and complete color developing temperature Tc was −10° C.

Manufacturing of Toner Particles

Toner Formulation 1:

| | |
|---|---|
| Polyester resin A (Tg 55° C.) | 85 parts by weight |
| Rice wax | 5 parts by weight |
| Colored particles A | 10 parts by weight |

The materials of the formulation were measured and uniformly mixed using the Henschel mixer. Thereafter, the materials were kneaded by a twin screw kneader set to 80° C. After being cooled by a belt cooler, a kneaded toner composition was coarsely crushed by the hammer mill to 2 mm or less and let to pass through an air grinding and classifying machine to manufacture particles having an average particle diameter of 8 μm.

Further, 2 parts by weight of hydrophobic silica and 0.5 part by weight of titanium oxide were added to the particles and, after being mixed by the Henschel mixer, the particles were let to pass through a sieve of #200 mesh to obtain a toner. Since the manufactured toner was decolored by the heat of the kneading, the toner was stored in a freezer at −20° C. and cooled to redevelop a color.

6 parts by weight of the obtained toner was mixed with 94 parts by weight of a ferrite carrier coated with silicone resin and was filled in the developing device 29. A temperature range in which the toner can be fixed on a sheet is 80° C. to 105° C. Since temperature at which decoloring of the colored particulates is started (hereinafter referred to as decoloring start temperature) is 107° C., fixing in a state in which the particulates develop the blue color is secured only up to about 105° C.

A relation between the toners and heating temperatures of the fixing device 13 is explained with reference to FIG. 4.

When the heating temperatures of the fixing device 13 are set, the following points should be taken into account.

1. In the decolorizable toner mode, the decolorizable toner is fixed at temperature lower than decoloring temperature of the decolorizable toner.

2. In the mixed mode, fixability of the undecolorizable toner and fixability and decolorability of the decolorizable toner are secured.

3. Fixing temperatures are same or substantially same in the decolorizable toner mode, in the undecolorizable toner single color mode and in undecolorizable toner color mode. In the fixing device 13, for example, a material having high heat storage properties such as rubber is used as a fixing member. Therefore, after the fixing device 13 is once heated, it takes time for temperature to drop. Therefore, if fixing temperature of the undecolorizable toner is higher than fixing temperature of the decolorizable toner, after the undeclorizable toner is fixed, it takes time to lower the fixing temperature to fixing temperature of the decolorizable toner. Therefore, it is necessary to set a temperature region for fixing same or substantially same in the decolorizable toner mode, the undecolorizable toner single color mode and undecolorizable color mode. In general, decoloring start temperature of the decolorizable toner may not be able to be set very high. Therefore, this condition can be satisfied by setting a fixable temperature range of the decolorizable toner lower than a fixable temperature range of the black toner.

Among the toners in this embodiment, the fixable temperature range of the decolorizable toner is 80° C. to 105° C. and a fixing temperature range of the yellow toner, the magenta toner, the cyan toner, and the black toner is 90° C. to 120° C. Decoloring start temperature of the decolorizable toner E is 107° C.

When the fixable temperature ranges of the toners are set as explained above, a fixing temperature range of the decolorizable toner and a fixing temperature range of the undecolorizable toner partially overlap. In the overlapping part, i.e., between a lower limit value (in FIG. 4, 90° C.) of the fixable temperature range of the undecolorable toner and an upper limit value (in FIG. 4, 105° C.) of the fixable temperature range of the decolorizable toner, the fixing temperatures for the decolorizable toner mode, for the undecolorizable toner single color mode and for the undecolorizable toner color mode are set. Since the fixing temperatures are set in this way, temperature switch of the fixing device 13 is not necessary when the image forming mode is changed among these three mode.

In this embodiment, both the fixing temperatures in the decolorizable toner mode and the undecolorizable toner single color mode are set to 95° C. However, the fixing temperatures may be set to different values as long as the condition explained above is satisfied.

In the mixed mode, fixing temperature is set to 110° C., which is higher than the decoloring start temperature 107° C. of the decolorizable toner and lower than an upper limit (in FIG. 4, 120° C.) of a fixable temperature range of the undecolorizable toners (the Y toner, the M toner, the C toner, and the BK toner).

Consequently, it is possible to form a mixed image of the undecolorizable toner and the decolorizable toner and, by fixing process, the decolorizable toner is decolorized. If fixing temperatures for the undecolorizable toner color mode are set at the same fixing temperature for the mixed mode, a temperature change is not necessary when the image forming mode is changed between the mixed mode and the undecolorizable toner color mode. In this case, the fixing temperatures for the undecolorizable toner color may be set to different values as long as the fixing temperatures are higher than the decoloring start temperature (107° C. in FIG. 4) of the decolorizable toner and lower than the upper limit value (120° C. in FIG. 4) of the fixable temperature range of the undecolorizable toners (the Y toner, the M toner, the C toner, and the BK toner).

As explained above, according to this embodiment, in the image forming apparatus including the plural undecolorizable toners, it is possible to perform image formation by the decolorizable toner without increasing the size of the apparatus.

In the image forming apparatus including both the undecolorizable toners and the decolorizable toner, the fixing temperatures can be set to the two temperatures, i.e., 95° C. and 110° C. Therefore, it is possible to smoothly perform switching of the image forming modes and reduce a waiting time for waiting for a temperature drop of the fixing device 13.

Figure 5:
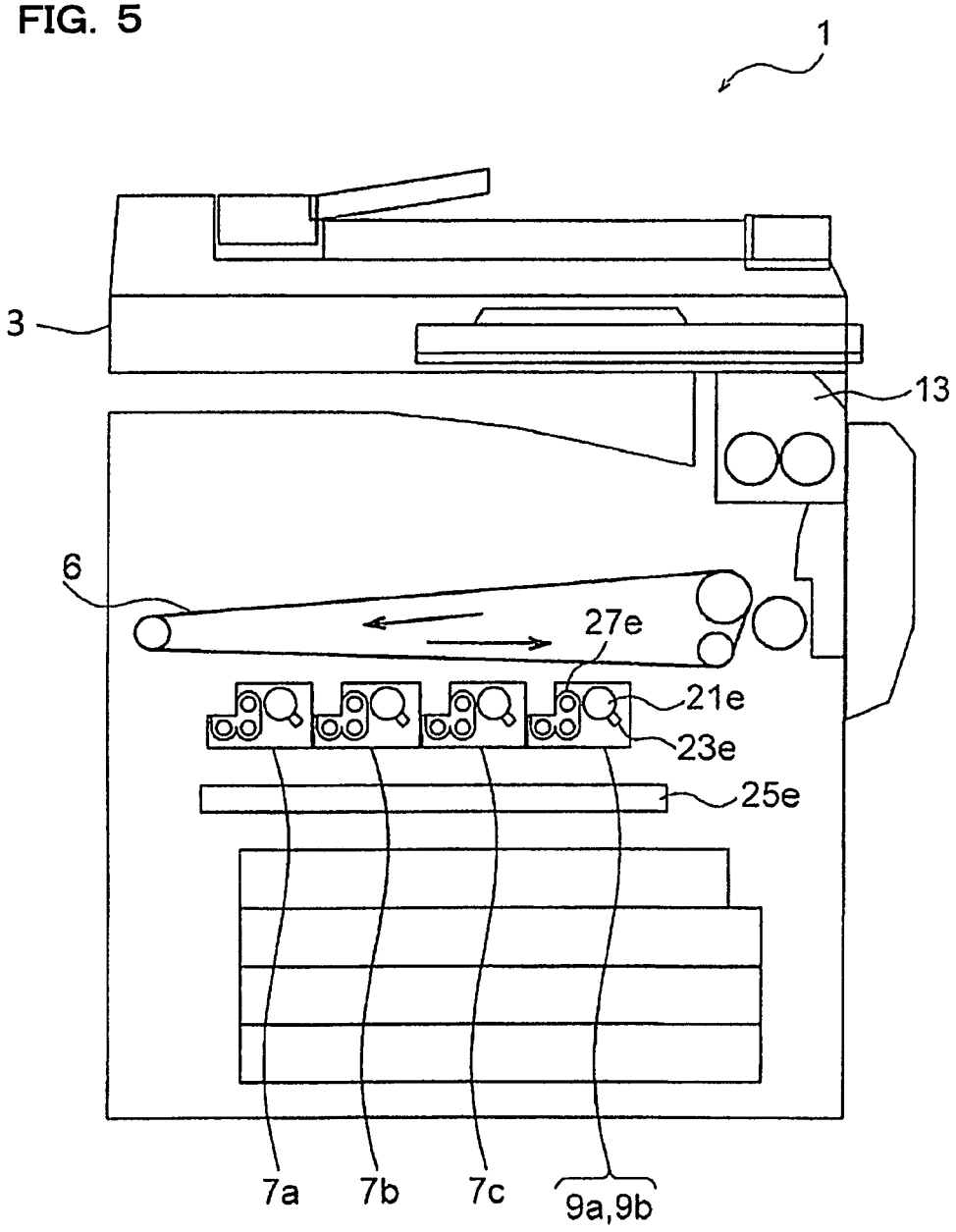
FIG. 5 is a sectional view of an image forming apparatus according to another embodiment.

FIG. 5 is a diagram of an image forming apparatus according to another embodiment. Explanation of components same as those of the image forming apparatus shown in FIG. 1 is omitted.

In the image forming apparatus shown in FIG. 5, an image forming portion 9*a* and an image forming portion 9*b* are replaceably attached to the MFP 1. Each of the image forming portions 9*a* and 9*b* is a process unit including a charging device 23*e* and a developing device 27*e* around a photoconductive drum 21*e*. An exposing device 25*e* of a laser exposure type is fixed on an apparatus main body side. In the image forming portion 9*a*, a blue decolorizable toner is stored in the developing device 27*e*. In the image forming portion 9*b*, a black undecolorizable toner is stored in the developing device 27*e*.

Figure 4:
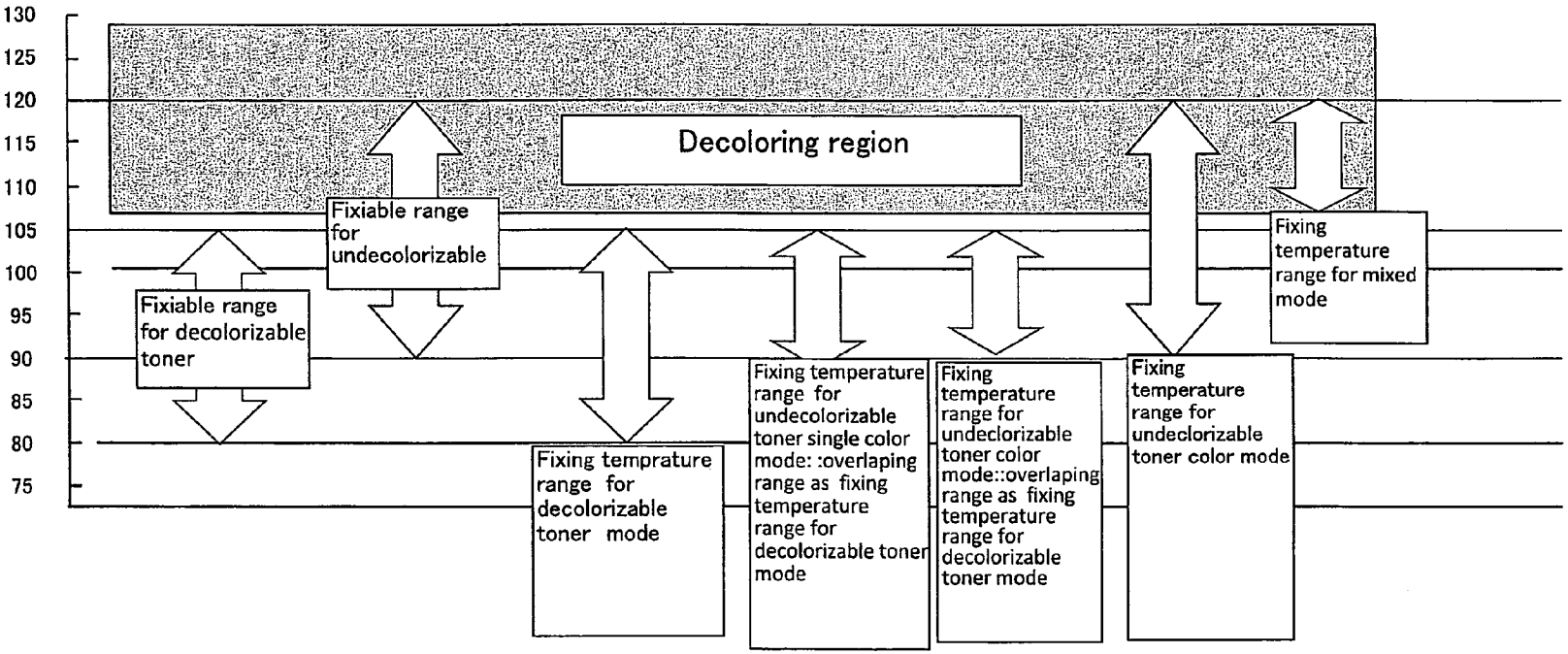
FIG. 4 is a diagram for explaining a relation between toners and heating temperatures of a fixing device in the embodiment.

When the image forming portion 9*a* and the image forming portion 9*b* can be replaced as explained above, as in the aforementioned embodiment, it is possible to arrange the decolorizable toner without increasing the size of the apparatus by setting a relation between the toners and the fixing temperatures to the relation shown in FIG. 4. Further, it is possible to smoothly perform switching of the image forming modes and reduce a waiting time for waiting for a temperature drop of the fixing device.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An image forming apparatus comprising:

a developing device configured to include a decolorizable toner;

a developing device configured to include an undecolorizable toner;

a control portion configured to selectively switch between a mode for forming an image with the decolorizable toner on a transfer material and a mode for forming an image with the undecolorizable toner on a transfer material; and a fixing portion configured to heat and fix the image formed with the decolorizable toner or undecolorizable toner on the transfer material, wherein fixing temperature ranges of the undecolorizable toner and the decolorizable toner partially has an overlapped temperature range with each other;

a heating temperature of the fixing portion is set in the overlapped temperature range.

2. The apparatus according to claim 1, wherein the fixing temperature range in which the undecolorizable toner is fixed and the fixing temperature range in which the decolorizable toner is fixed are different and have an overlapping range.

3. The apparatus according to claim 1, wherein the image forming apparatus has a mode for forming an image with only the decolorizable toner and a mode for forming an image with only the undecolorizable toner.

4. The apparatus according to claim 1, wherein the developing device including the decolorizable toner is located in a position upstream of the developing device including the undecolorizable toner along a rotating direction of the image bearing member.

5. The apparatus according to claim 1, wherein the developing device including the decolorizable toner and the developing device including the undecolorizable toner are replaceably mounted on the image forming apparatus.

6. An image forming apparatus comprising:

a first image forming portion configured to form a toner image with an undecolorizable toner;

a second image forming portion configured to selectively form a toner image on an image bearing member using a developing device including a decolorizable toner or a developing device including the undecolorizable toner;

a transfer portion configured to transfer the toner image, which is formed by the first image forming portion, and the toner image, which is formed with the decolorizable toner of the second image forming portion, onto a transfer material; and a fixing portion configured to fix the toner image, which is transferred by the transfer portion, on the transfer material, wherein fixing temperature ranges of the undecolorizable toner and the decolorizable toner partially has an overlapped temperature range with each other;

a heating temperature of the fixing portion is set in the overlapped temperature range.

7. The apparatus according to claim 6, wherein the apparatus forms, on the transfer material, the toner image by the undecolorizable toner of the first image forming portion and the toner image by the decolorizable toner of the second image forming portion and fixes the toner images using the fixing portion to thereby decolor the decolorizable toner and form an image.

8. The apparatus according to claim 6, wherein the developing device including the decolorizable toner is located in a position upstream of the developing device including the undecolorizable toner along a rotating direction of the image bearing member.

9. The apparatus according to claim 6, wherein the developing device including the decolorizable toner and the developing device including the undecolorizable toner are replaceably mounted on the apparatus.

10. An image forming method of an image forming apparatus which include a decolorizable toner and an undecolorizable toner, the method comprising:

switching selectively between a mode for forming an image with the decolorizable toner on a transfer material and a mode for forming an image with the undecolorizable toner on a transfer material; and heating and fixing the image formed with the decolorizable toner or undecolorizable toner on the transfer material, wherein fixing temperature ranges of the undecolorizable toner and the decolorizable toner partially has an overlapped temperature range with each other;

a heating temperature of the fixing portion is set in the overlapped temperature range.

* * * * *